United States Patent [19]

Collignon et al.

[11] 4,196,954

[45] Apr. 8, 1980

[54] UNLOCKING AND EXTRACTING DEVICE FOR AN ELECTRICAL CONNECTOR

[75] Inventors: Roger Collignon; Claude Casses, both of Suresnes, France

[73] Assignee: Socapex, Suresnes, France

[21] Appl. No.: 24,855

[22] Filed: Mar. 28, 1979

[30] Foreign Application Priority Data

Mar. 31, 1978 [FR] France ..... 78 09570

[51] Int. Cl.[2] ..... H01R 13/62

[52] U.S. Cl. ..... 339/45 M

[58] Field of Search ..... 339/45; 29/762–764, 29/219, 220, 267; 269/13

[56] References Cited

U.S. PATENT DOCUMENTS

| | | | |
|---|---|---|---|
| 1,480,513 | 1/1924 | Daniken | 29/219 |
| 2,221,402 | 11/1940 | Kurtzon | 339/45 T |
| 3,111,355 | 11/1963 | Samburoff | 339/45 R X |
| 3,723,944 | 3/1973 | Gauchat | 339/45 R |

*Primary Examiner*—Joseph H. McGlynn
*Assistant Examiner*—John S. Brown
*Attorney, Agent, or Firm*—Cushman, Darby & Cushman

[57] ABSTRACT

A connector of the locking type, in which, due to a large number of contacts, the manual force required for disconnection, is increased by an extracting device (23). In order to assure that the extraction step is not started until after the end of the unlocking step carried out by the lever (21), the invention provides for the manual force to act solely on the unlocking lever (21) and for the unlocking lever (21) subsequently to act on the extracting lever (25), the necessary delay between the two steps being ensured by creating a distance (L) between the two levers.

7 Claims, 5 Drawing Figures

UNLOCKING AND EXTRACTING DEVICE FOR AN ELECTRICAL CONNECTOR

This invention relates to electrical connectors and more particularly to electrical connectors of the type formed by a fixed base and a mobile plug. In numerous applications where these connectors are fixed to apparatus subjected to vibration, the actual mobility of the plug leads to the risk of accidental removal of the plug from the base with all the troublesome effects which this involves on the operation of the apparatus in question. Accordingly, attempts have long been made to provide the connectors with devices for locking a plug to a base.

Another factor which has to be taken into account in the operation of connectors of the type in question is the force which has to be applied to the mobile plug to effect disconnection in the case of a large number of contacts and which is becoming increasingly higher with the development of the art. Although the unit friction force of a male pin in a female socket is moderate, the sum of these forces in the case of several tens of contacts of this type leads to a considerable unplugging force. Devices known as extractors have been proposed with a view to overcoming this difficulty, comprising generally a transformation of the forces by levers or screws.

However, although these extractors are generally satisfactory, their action still has to be co-ordinated with the action of the locks whose existence and function were mentioned above.

This means that the extraction stage can only be carried out after the locks have been taken out of operation in a preliminary unlocking stage. Unless this requirement is satisfied, there is, in practice, a serious risk of damage to the elements in question, as has been observed in practice in the event of an error or negligence on the part of the user.

The present invention obviates this disadvantage. It uses a device which reliably ensures the chronological succession of the two unlocking and extraction stages and, in one particularly advantageous embodiment, lends itself to installation and satisfactory operation in existing connectors of the type in common use.

Basically, the invention uses two levers, namely an unlocking lever and an extracting lever, and provides coupling means between these two levers which enable the extracting lever to be controlled by the unlocking lever, but only after the unlocking lever has assumed its function.

More precisely, it is provided an unlocking and extracting device for an electrical connector formed by a fixed base and a mobile plug, and comprising co-operating locking means carried respectively by the base and the plug, said device comprising a first lever provided with a control end which acts on the unlocking of these means, and a second lever provided with a control end, which acts on the mobile plug to extract it from the fixed base, wherein the two levers are disposed with their respective control ends at a predetermined distance from one another, the first lever actuating the second lever by mutual contact of these ends.

The invention will better understood from the following description in conjunction with the accompanying drawings, wherein:

-FIG. 1 shows a locking connector of known type.

-FIG. 2 (a) (b) (c) shows one embodiment of the device according to the invention in three steps of operation.

Figure 1:
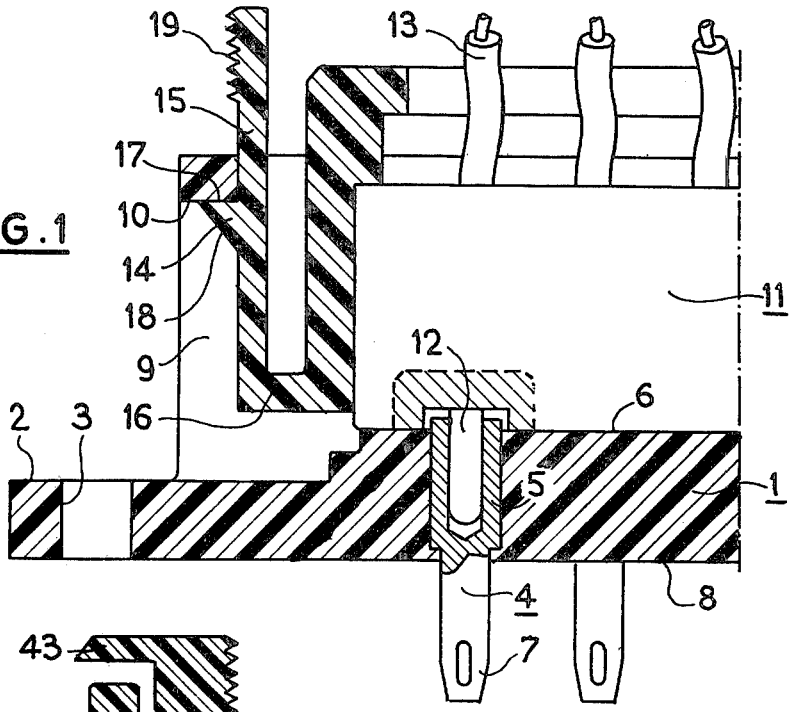
FIG. 1 is a partial section through a locking connector of known type with which the device according to the invention may be associated.

This connector is formed by a base 1 provided with fixing lugs, such as 2, with a hole 3 for the introduction of a screw for example, the base 1 supporting a plurality of connecting elements, such as 4. These contacts have a plug-in end 5 emerging at the upper plug-in surface of the base 6 and a connecting end at which they are connected to the external circuits, such as 7, and which opens at the lower connecting surface 8 of the base 6. The upper surface is surrounded by walls, such as 9, which together from a kind of compartment for receiving the mobile plug. Some of these walls are formed with openings of which certain peripheral parts, such as 10, may be used as supporting surfaces.

On the other hand, the connector is formed by a mobile plug 11 comprising a plurality of contact elements provided with a front part in the form of a pin 12 of the male type and with a rear part for connection to external circuits by wires such as 13.

Locking is effected by locks formed by a hook 14 carried by a lever 15 hinged at one end 16 by which it is connected to the mobile plug 11 of the connector, the hinge being elastic.

The hook has a supporting surface 17 and an entry surface 18 in the form of an inclined plane.

After insertion, the plug is locked by pivoting the lever 15 about its hinge 16 under the action of the inclined entry surface 18 of the hook which rests on the inner surface 10 of the compartment. The lever then returns elastically to its initial position, causing the hook 14 to project and rest on the inner supporting surface 10.

The plug is removed after release of the lock by manual pressure on the surfaces, such as 19, with manual traction of the mobile plug in the outward direction.

Although this traction may in principle by applied by the surface 19, the occasionally considerable force which, as explained above, has to be applied in the case of a large number of contact elements makes it impossible to extract the mobile plug by these surfaces and the user is forced to pull on the wires 13 themselves, thus exposing the connecting regions between the wires and the contact elements of the movable plug to a serious risk of breakage.

Figure 2A:
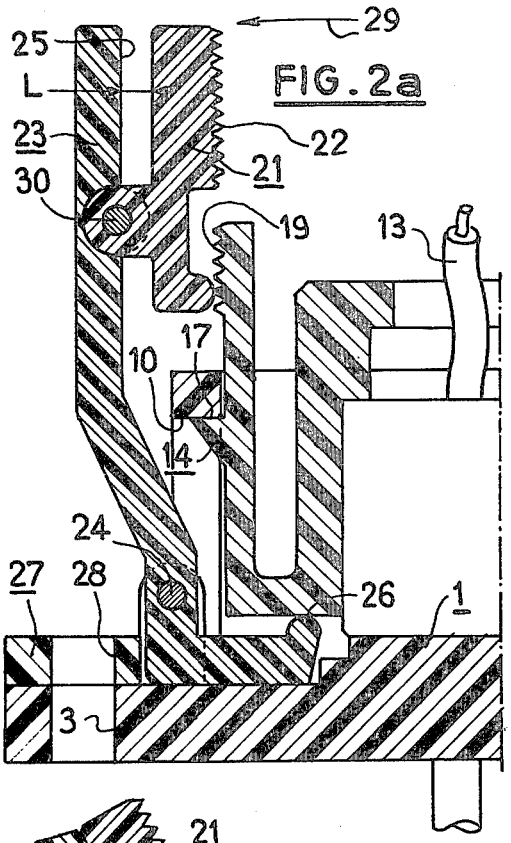
Figure 2B:
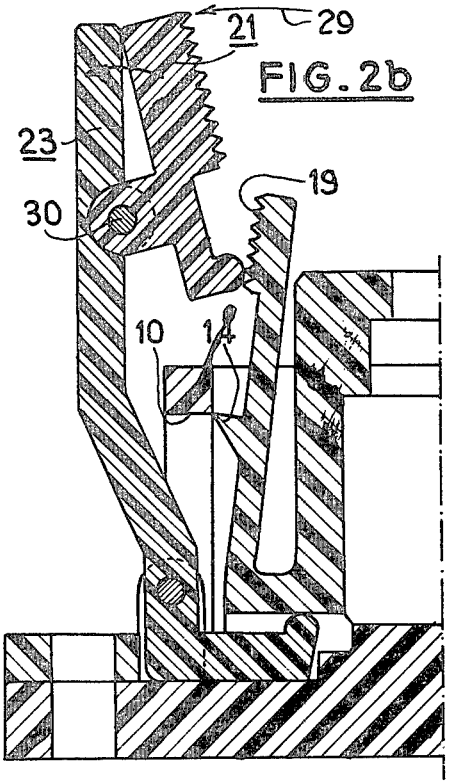

FIG. 2 shows one embodiment of the device according to the invention in different stages of its operation as illustrated in three drawings (a) (b) (c).

FIG. 2 (a) shows the unlocking and extracting device associated with a connector of the type shown in FIG. 1.

Unlocking is effected by a lever 21 hinged at its centre. At one end, it has a surface 22 for applying a control force and, at its other end, rests on the unlocking surface 19 of the connector illustrated in FIG. 1.

Extraction is effected by a lever 23 hinged at 24. At one end, it has a surface 25 for applying a control force and, at its other end, rests on a lower surface 26 of the mobile plug. The point about which the extracting lever pivots is situated in a support bearing 27 where an opening 28 is formed. By aligning this opening with the opening 3 in the fixing lug carried by the base of the connector, the device according to the invention may be fixed to an existing connector of the type described, thus providing for greatly improved use of the connector. Fixing may be carried out by means of a nut and bolt of the type normally used for fixing the connector to the associated apparatus. However, one particularly advantageous method of fixing consists in using a so-called "tubular" rivet whose insertion and setting leave a tubular opening enabling the base to fixed independently of the device according to the invention.

According to one feature of the invention, the respective control ends of the unlocking lever 21 and the extracting lever 23, which are intended to apply a force, are disposed one in front of the other at a predetermined different L apart.

A device such as this operates as follows:

With the connector in its inserted position, a force is applied to the control end 22 of the unlocking lever in the direction of the arrow 29. As shown at (b), this lever pivots about its hinge 30 and, at its end, acts on the unlocking surface 19 of the connector. The unlocking lever is thus "controlling" and the extracting lever "controlled".

However, the extracting lever 23 remains immobile on account of the distance L separating the two control ends of the two levers.

Figure 2C:
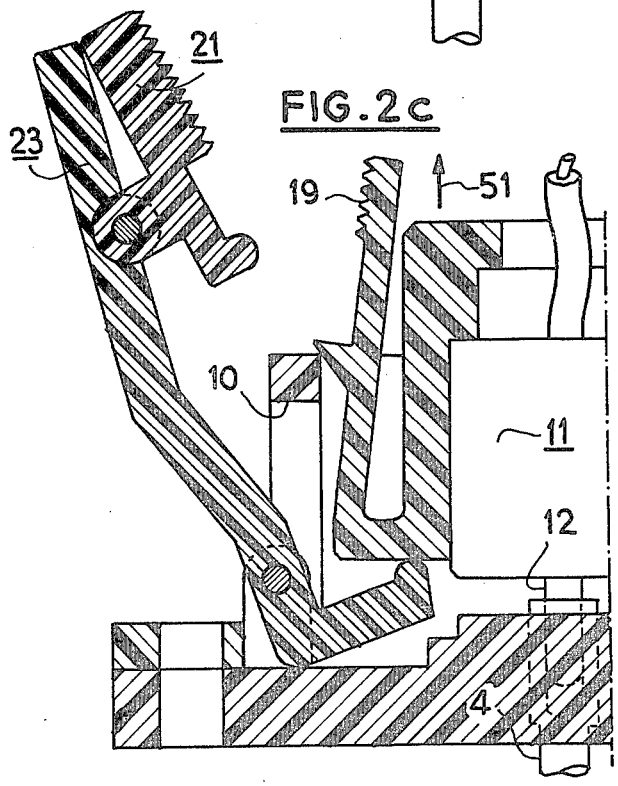

When these two ends come into contact with one another, as shown in FIG. 2 (b), the force applied to the lever 22 is transmitted to the lever 23 which thus pivots about the hinge 24 under this force. The extraction step may then take place in the direction of the arrow 51, as shown in FIG. 2(c).

The succession of the two steps is thus made possible in the necessary logical order, i.e. first unlocking and then extraction, by the presence of a predetermined distance L between the control ends of the two levers.

It should be noted that, in the embodiment of the device given by way of example, the point 30 about which the unlocking lever 21 pivots is carried by the extracting lever 23. This arrangement enables the orders of magnitude of the relative amplitudes of the necessary movements in the two stages to be conveniently obtained.

However, it is possible in accordance with the invention to use any other pivoting point for the unlocking lever, the fundamental feature of the invention being that a given distance L is created between the controlling unlocking lever 22 and the controlled extracting lever 23.

Figure 3:
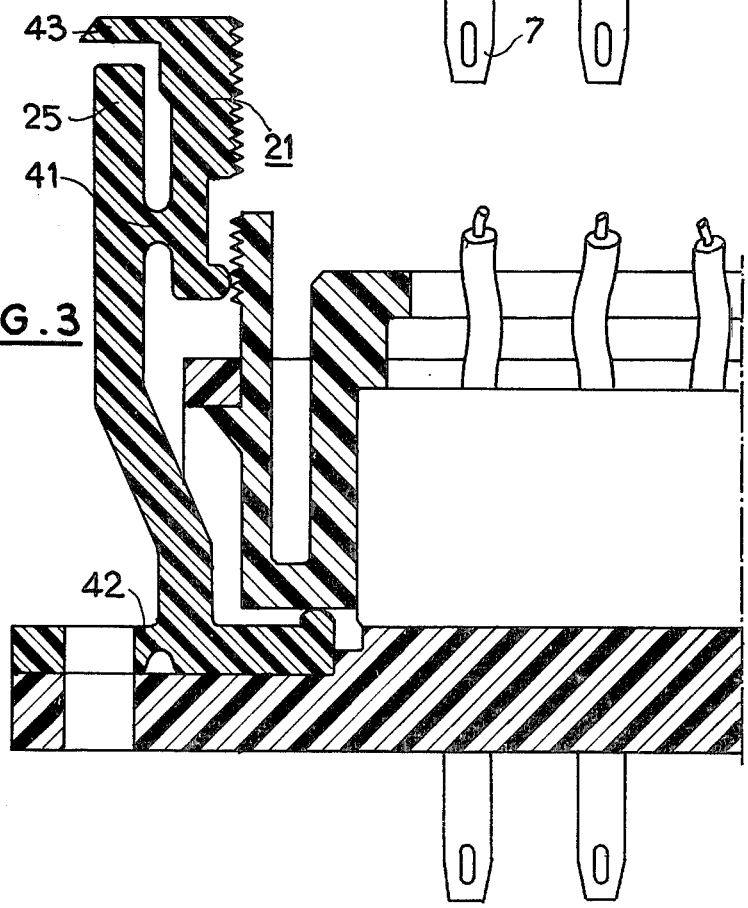
FIG. 3 shows another embodiment of this device.

FIG. 3 shows another embodiment of the device according to the invention. In this embodiment, the entire device is made from a single block of one and the same material, the hinges being formed by parts of reduced thickness, such as 41 and 42. The controlling unlocking lever 21 is provided at its control end with a plate 43 covering the end of the controlled extracting lever 23 which prevents the action of the user from being accidentally exerted directly on this lever.

It is pointed out that the device according to the invention has been described with reference to its association with an existing connector of known type. However, the device according to the invention may of course also be used in a connector of which it forms an integral part.

What we claim is:

1. An unlocking and extracting device, for an electrical connector formed by a fixed base (1) and a mobile plug (11), and comprising co-operating locking means (10) (14) carried respectively by the base and the plug, said device comprising a first lever (21) provided with a control end, which acts on the unlocking of these means, and a second lever (23) provided with a control end, which acts on the mobile plug to extract if from the fixed base, wherein the two levers are disposed with their respective control ends (22) (25) at a predetermined distance (L) apart from one another, the first lever applying a force to the second lever by mutual contact of these two ends.

2. An unlocking and extracting device as claimed in claim 1, wherein are comprised means preventing a mechanical action on the second lever independently of the action of the first lever.

3. An unlocking and extracting device as claimed in claim 1, wherein the point about which the first lever pivots is situated at a mobile point of the second lever.

4. An unlocking and extracting device as claimed in claim 1, wherein the point about which the second lever pivots is supported by a bearing integral with the fixed base.

5. An unlocking and extracting device as claimed in claim 1, wherein the point about which the second lever pivots is supported by a bearing removable from the fixed base, this bearing being fixed to the base by using the fixed lugs with which it is provided.

6. An unlocking and extracting device as claimed in claim 5, wherein the use of the fixing lugs of the base comprises the use of tubular rivets simultaneously introduced into openings respectively formed in a fixing lug and a bearing of the device.

7. An unlocking and extracting device as claimed in any of the preceding claims, formed from a single block of one and the same material, the hinges of the first and second levers being formed by mechanically flexible regions in the form of local reductions in thickness.

* * * * *